US007063035B2

(12) United States Patent
Belcher

(10) Patent No.: US 7,063,035 B2
(45) Date of Patent: Jun. 20, 2006

(54) BOAT MOUNTED BLIND

(76) Inventor: Larry J. Belcher, 1395 S. Folsomville Rd., Boonville, Warrick County, IN (US) 47601

( * ) Notice: Subject to any disclaimer, the term of this patent is extended or adjusted under 35 U.S.C. 154(b) by 0 days.

(21) Appl. No.: 11/126,794

(22) Filed: May 11, 2005

(65) Prior Publication Data

US 2005/0252438 A1 Nov. 17, 2005

Related U.S. Application Data

(60) Provisional application No. 60/570,197, filed on May 11, 2004.

(51) Int. Cl.
*B63B 35/00* (2006.01)

(52) U.S. Cl. ..... 114/351; 114/361; 135/901

(58) Field of Classification Search ..... 114/343, 114/351, 361; 135/901
See application file for complete search history.

(56) References Cited

U.S. PATENT DOCUMENTS 5,361,716 A * 11/1994 Cotton ..... 114/230.11
5,458,079 A * 10/1995 Matthews et al. ..... 114/351
6,769,379 B1 * 8/2004 Foiles ..... 114/351

* cited by examiner

*Primary Examiner*—Lars A. Olson
(74) *Attorney, Agent, or Firm*—Gary K. Price, Esq.

(57) ABSTRACT

A portable, boat-supported duck blind that is collapsible and adjustable to fit most conventional boats. The boat mounted blind of the present invention includes two substantially identical elongated members, said members are positioned parallel to each other along both sides of the boat, front and rear cross-posts are connected to the elongated members, and first and second upper rails are connected to the cross-posts. Each elongated member is attached to a side of the boat with a pair of bendable posts, and a pair of cylinders is attached to the boat and the elongated members to assist the user in raising or collapsing the blind with minimal effort.

19 Claims, 5 Drawing Sheets

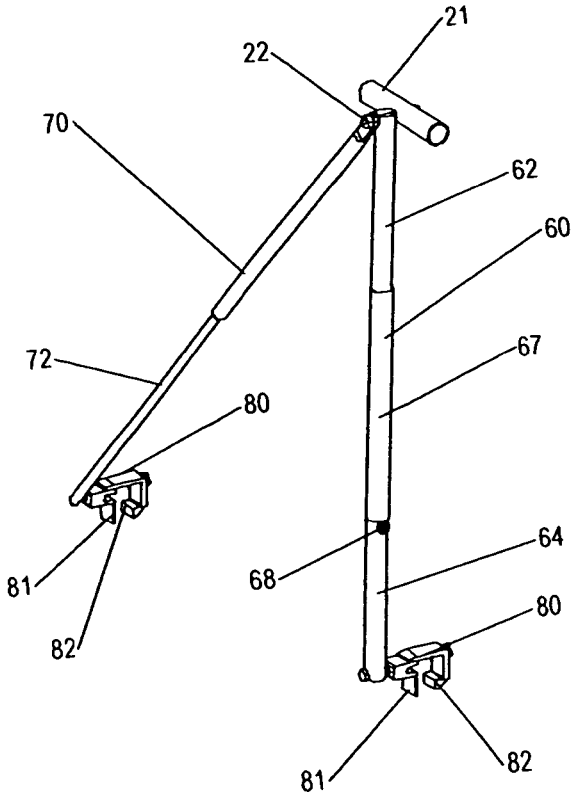
FIG. 4
FIG. 5
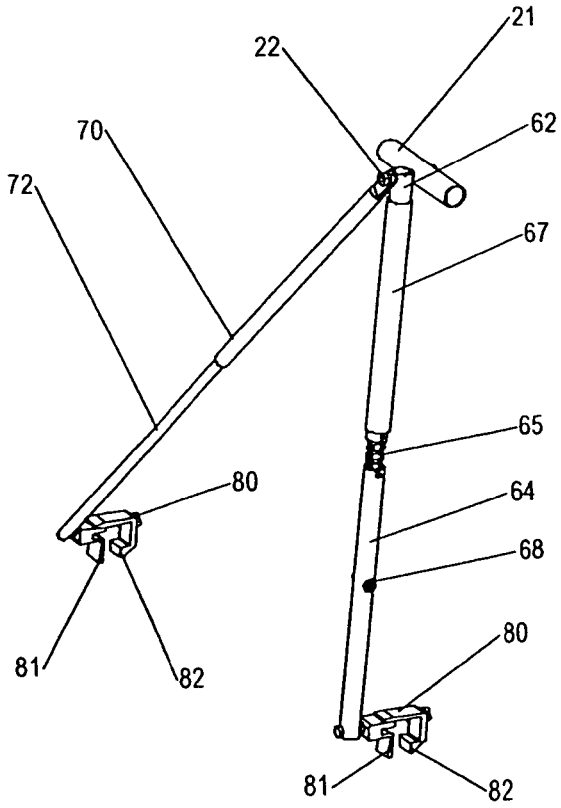

BOAT MOUNTED BLIND

CROSS REFERENCES TO RELATED APPLICATIONS

U.S. Provisional Application for Patent No. 60/570,197, filed May 11, 2004, with title "Boat Mounted Blind" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to a blind for use in hunting waterfowl by boat, more particularly a blind adapted to being quickly raised and lowered while in use on a boat and being easy to install.

2. Brief Description of Prior Art

Hunters use boat mounted blinds for concealment when hunting waterfowl. During the past few years, portable blinds have become increasingly popular to waterfowl hunters, primarily duck hunters, due to their convenience and versatility over stationary blinds.

Several desirable features of a portable duck blind include adaptability for different sized boats, ease of attachment to a boat, ease of operation, collapsibility to a lowered position for storage and transportation, and the ability to allow a hunter to shoot in any direction. The prior art blinds typically do not provide one or more of these desirable features. Some perform acceptably well once installed, but must be custom built for the particular boat for which they will be used. Others are more adaptable for different sized boats, but are unnecessarily complicated to install or cumbersome to use. Accordingly, a need has been recognized for an improved portable duck blind which solves these deficiencies in the prior art.

As will be seen from the subsequent description, the preferred embodiments of the present invention overcome shortcomings of the prior art.

SUMMARY OF THE INVENTION

The present invention relates to blinds used for hunting waterfowl, and more particularly, to a portable, boat-supported duck blind that is collapsible and adjustable to fit most conventional boats. The boat mounted blind of the present invention includes two substantially identical elongated members parallel to each other along both sides of the boat. Front and rear cross-posts are pivotally connected to the elongated members. The rear cross-post having an offset design to avoid interfering the boat's tiller steer. A first upper rail is pivotally connected to the front and rear cross-post, in parallel relationship to the members, and a second upper rail is pivotally connected to the front and rear cross-post, in parallel relationship to the members and the first upper rail.

Each elongated member is attached to a side of the boat with a pair of posts. Each of the posts include an upper portion that is attached to the elongated member, and a lower portion that is attached to the side of the boat. The post further includes a bendable link sandwiched between the upper and lower portion. A sleeve can be positioned over the bendable link when the blind is in the raised position. A pair of cylinders comprising a ram that is telescopically adjusted to an extended or retracted position is attached to each elongated member. In particular, the ram of the cylinder is attached to the side of the boat and the opposite end of the cylinder is attached to the elongated member. As will be described, the cylinders assist the user in raising or collapsing the blind with minimal effort. The cylinders further add stability to the blind when in the upright position.

Cables or similar flexible cordlike material attach to the first and second upper rails to adjust the locations of the upper rails.

BRIEF DESCRIPTION OF THE DRAWINGS

FIG. 4 illustrates a locking post member in the raised position and further illustrates a sleeve positioned over a bendable link in the locking post.

FIG. 5 illustrates the locking post member of FIG. 4 wherein the sleeve is upwardly positioned to expose the bendable link in the locking post.

DESCRIPTION OF THE PREFERRED EMBODIMENTS

Figure 1:
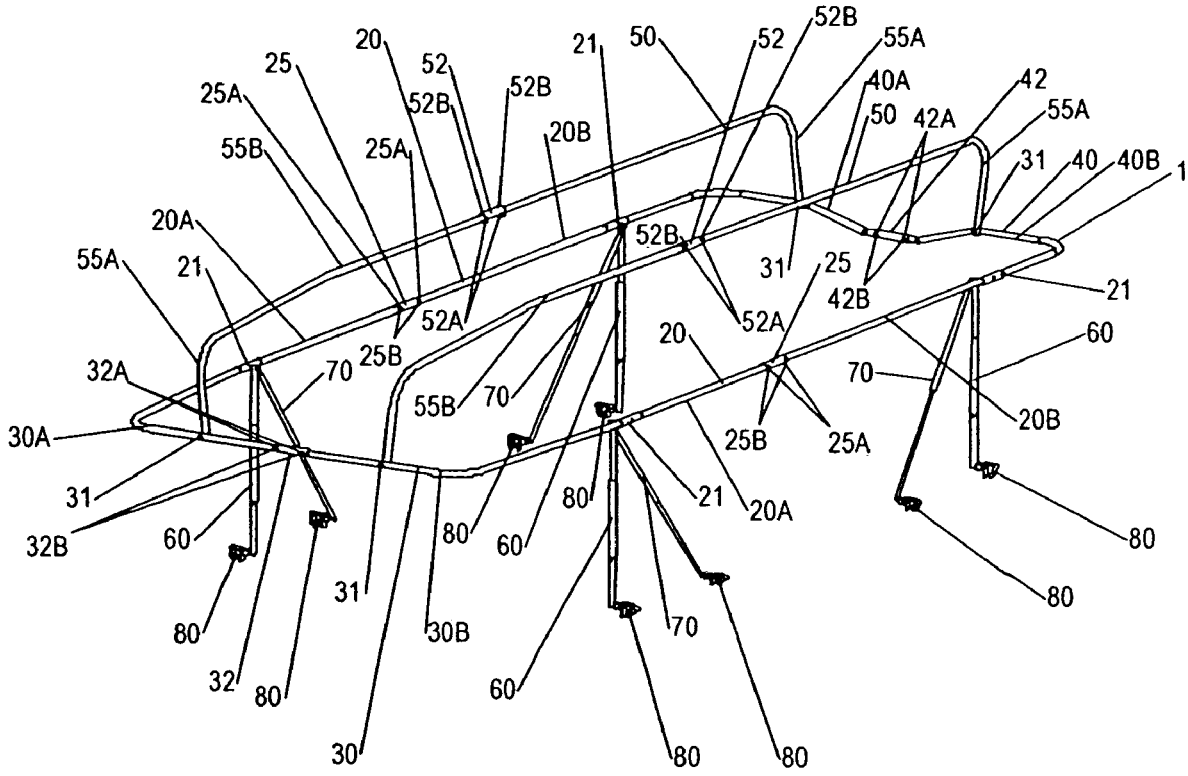
FIG. 1 illustrates a perspective view of the present invention, a boat mounted blind in the raised position.

FIGS. 1–6 illustrate a preferred embodiment of a boat mounted blind 10 made in accordance with the present invention. The boat mounted blind 10 provides a new and improved collapsible blind for attachment to a prior art boat 100, such blind 10 being adjustable to fit most conventional boats.

The blind 10 of the present invention is designed to be secured to a conventional boat commonly used by hunters, such as duck hunters. For purposes of this invention, the configuration of the boat is largely irrelevant, as blind 10 is designed to fit on almost any conventional boat, as explained more fully below.

For the sake of clarity, the drawings illustrate blind 10 without a camouflage cover. The type of camouflage covering material used is not critical to the present invention. In fact, a benefit of the present invention is that most any camouflage material can be adapted for use with the blind 10, thus permitting the hunter to adapt the camouflage for the particular hunting environment.

Referring to the drawings, blind 10 includes two substantially identical elongated members 20, the members 20 are positioned parallel to each other along both sides of the boat 100. The framework of the blind 10 further includes a front cross-post 30, and a rear cross-post 40. As will be further described, the framework of the blind 10, including the elongated members 20, and the front and rear cross-posts 30, 40, are designed to adjustably fit most conventional boats.

In the preferred embodiment, each of the pair of the elongated members 20 are constructed of two members 20A, 20B that are joined at sleeve 25 to form elongated member 20. In particular, the two members 20A, 20B are slidably received within sleeve 25. Preferably, sleeve 25 has a length of about six inches. In this regard, members 20A, 20B are selectively positioned within the sleeve 25 in order to adjust to the length of the boat. Sleeve 25 further includes a pair of screw holes 25A and screws 25B in order to secure members 20A, 20B within the sleeve 25 at the selected length.

As illustrated, the distal ends of the elongated members 20 are slidingly received in post sleeves 21. The distal ends of the front cross-post 30 are also slidingly received in the post sleeves 21 thereby joining the front cross-post 30 and the elongated members 20 in perpendicular relationship. The distal ends of the rear cross-post 40 are likewise slidingly received in the post sleeves 21 thereby joining the rear cross-post 40 and the elongated members 20 in perpendicular relationship, and substantially parallel to the front cross-post 30. Preferably, post sleeve 21 has a length of about six inches. In this regard, the elongated members 20 and posts 30, 40 can be selectively positioned with sleeve 21 in order to adjust to the length of the boat.

Figure 2:
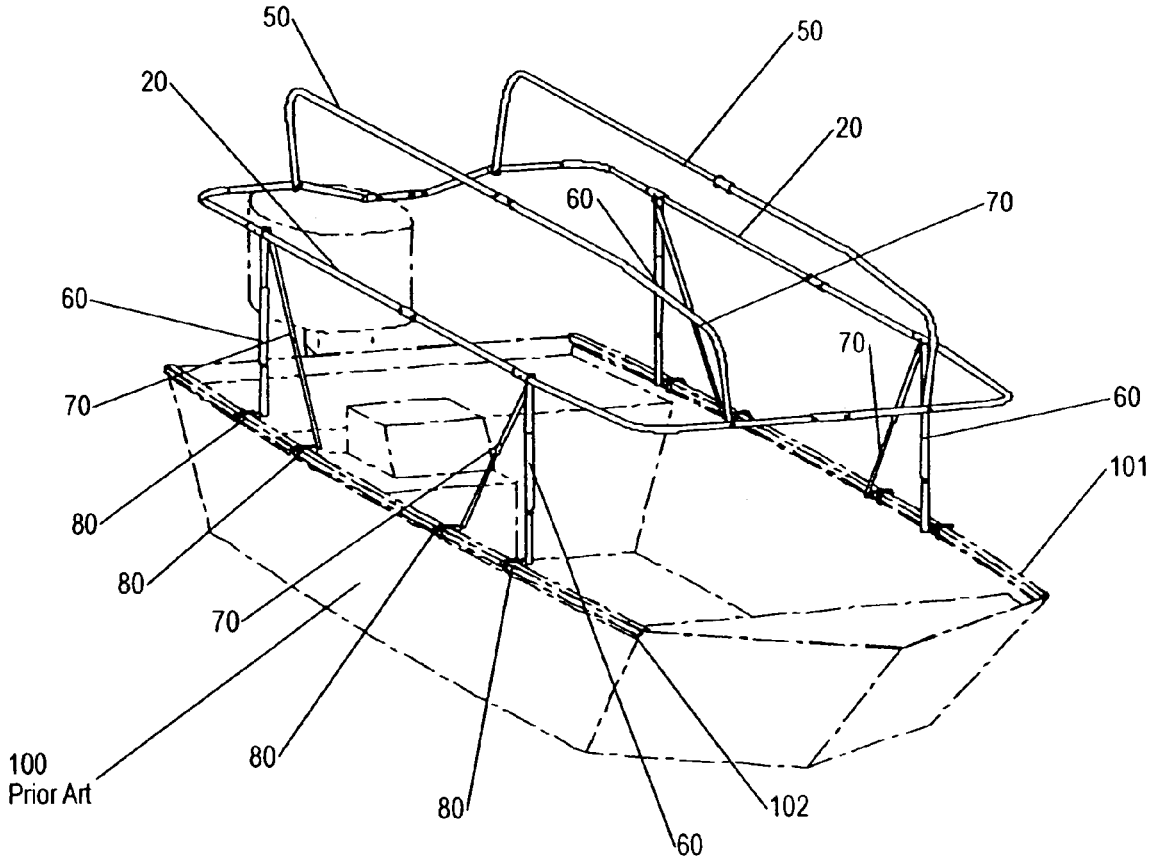
FIG. 2 is illustrates a perspective view of the boat mounted blind of FIG. 1 attached to a prior art boat.

As best shown in FIGS. 1 and 2, the rear cross-post 40 includes an integral offset portion 40A. The offset portion 40A designed to avoid, or not interfere with the tiller steer (now shown) of the boat 100, when as will be described, the blind 10 is in a collapsed position.

In the preferred embodiment, the front cross-post 30 is constructed of two members 30A, 30B that are joined at sleeve 32 to form the front cross-post 30. In particular, the two members 30A, 30B are slidably received within sleeve 32. Preferably, sleeve 32 has a length of about six inches. In this regard, members 30A, 30B are selectively positioned within sleeve 32 in order to adjust to the width of the boat. Sleeve 32 further includes a pair of screw holes 32A and screws 32B in order to secure members 30A, 30B within the sleeve 32 at the selected width. Likewise, in the preferred embodiment, the rear cross-post 40 is constructed of two members 40A, 40B that are joined at sleeve 42 to form the rear cross-post 40. Particular, the two members 40A, 40B are slidably received within sleeve 42. Preferably, sleeve 42 has a length of about six inches. In this regard, members 40A, 40B are selectively positioned within sleeve 42 in order to adjust to the width of the boat. Sleeve 42 further includes a pair of screw holes 42A and screws 42B in order to secure members 40A, 40B within the sleeve 42 at the selected width.

A first upper rail 50 is pivotally connected with fasteners 31 to the front and rear cross-posts 30, 40, in parallel relationship to the members 20, and a second upper rail also designated as numeral 50 in the drawings is pivotally connected with fasteners 31 to the front and rear cross-post 30, 40, in parallel relationship to the members 20 and the first upper rail 50.

Figure 3:
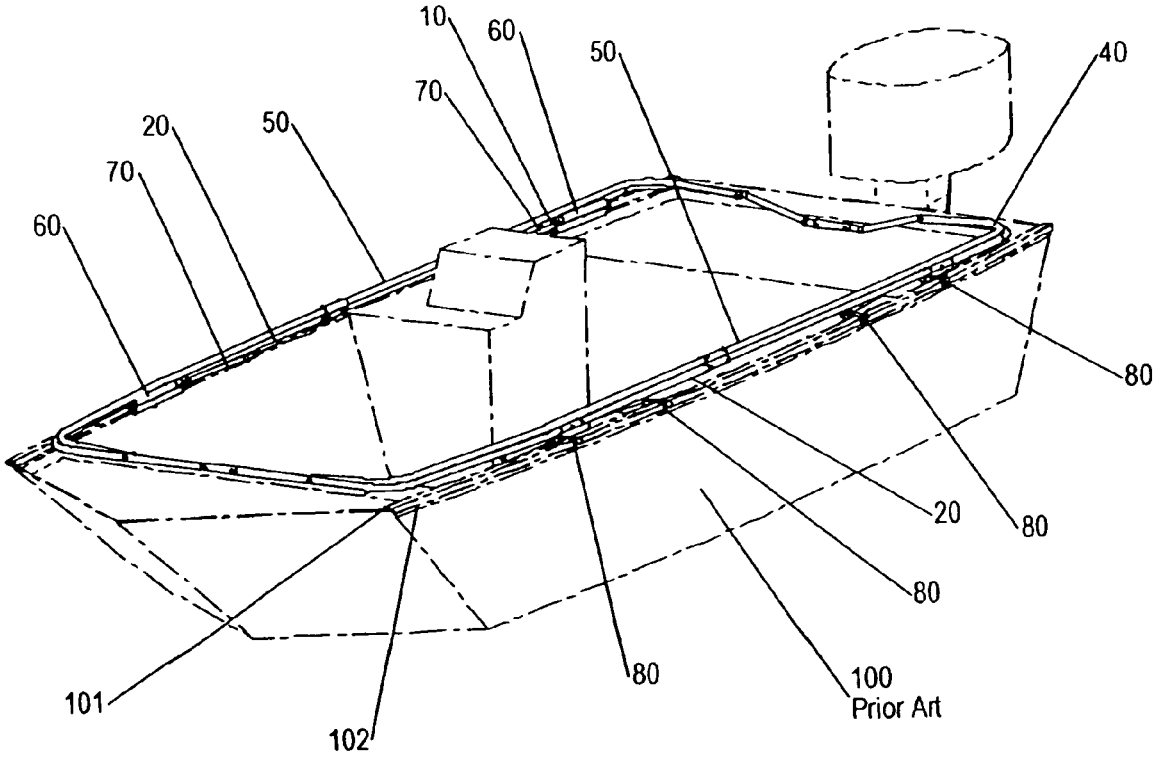
FIG. 3 illustrates a perspective view of the boat mounted blind of FIG. 2 in the collapsed position.
Figure 6:
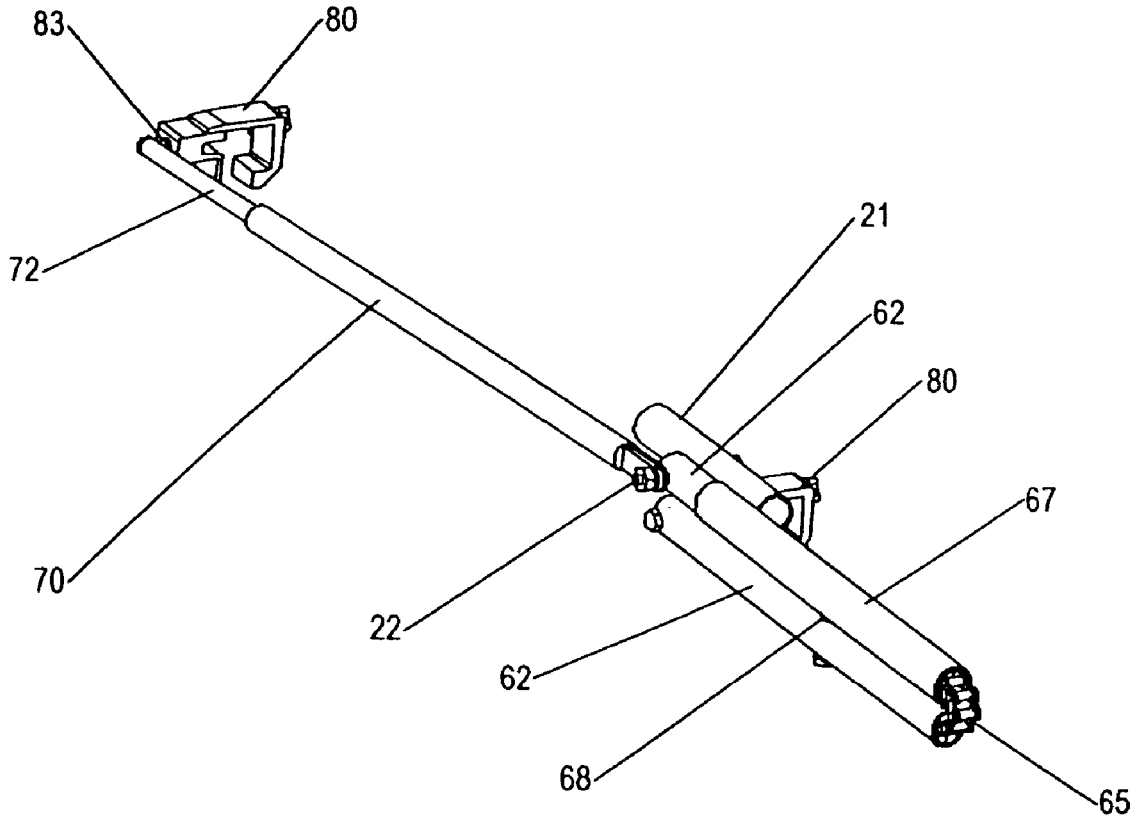
FIG. 6 illustrates the locking post in the collapsed position.

In the preferred embodiment, the first-and second upper rails 50 are each constructed of two members 50A, 50B that are joined at sleeve 52 to form the rails 50. Particularly, the two members 50A, 50B are slidably received within sleeve 52. Preferably, sleeve 52 has a length of about six inches. In this regard, members 50A, 50B are selectively positioned within sleeve 52 in order to fit the length of the boat. Sleeve 52 further includes a pair of screw holes 52A and screws 52B in order to secure members 50A, 50B within the sleeve 52 at the selected length. Each elongated member 20 is attached to a side of the boat with at least a pair of locking posts 60. Referring to FIGS. 4 and 5, each of the posts 60 include an upper portion 62 that includes the post sleeve 21 as described above, and a lower portion 64 that is hinged to a grip 80, the grip 80 is attached to the side of the boat 100. The post 60 further includes a bendable link 65 (best shown in FIG. 5) sandwiched between the upper and lower portions 62,64. The bendable link 65 allows the user to bend the posts 60 at the approximate midway of the length of the post 60 when the blind 10 is in the collapsed position as shown in FIG. 3.

The post 60 further includes a sleeve 67 that can be selectively positioned along the length of the post 60. Positioning the sleeve 67 over the bendable link 65 (best shown in FIG. 4) when the blind 10 is in the raised position adds stability to the post 60 and prevents the post 60, at the location of the bendable link 65, from unwanted bending while the blind 10 is in the raised position. The lower portion 64 includes a stop 68 in order to properly position the sleeve 67 over the link 65 and to prevent the sleeve 67 from downwardly sliding along the post 60 beyond the link 65.

In the preferred embodiment, the bendable link 65 is constructed of #50 roller chain however, other suitable materials can be used.

To assist the user in adjusting the blind 10 from the collapsed (FIG. 3) to the raised (FIGS. 1 and 2) position, the blind 10 further includes at least one cylinder 70 positioned on each side of the boat. Each cylinder 70 includes a ram 72 that is telescopically adjusted to an extended or retracted position. The ram 72 of the cylinder 70 is preferably attached to the side of the boat with grip 80, and the opposite end of the cylinder 70 is rotatably attached to the upper portion 62 of the locking post 60 with fasteners 22.

As should be understood, the cylinders 70 will be in the extended position when the blind 10 is in the raised position and, the cylinders 70 will be in the retracted position when the blind 10 is in the collapsed position.

In application, the cylinders 70 adjust to either the extended or retracted position by the user urging the blind 10 in the selected position. For example, urging either one of the cross-posts 30, 40 or one of the elongated members 20 downward will cause the cylinders 70 to activate from the extended position to the retracted position, and would therefore urge the blind 10 from the raised position to the collapsed position. As such, the cylinders 70 assist the user to raise or collapse the blind 10 with minimal effort. It should be understood that the cylinders 70 further add stability to the blind 10 when in the raised position as shown in FIGS. 1 and 2.

As stated, the cylinders 70 are known in the art. The cylinders' 70 actuating means could be, but are not restricted to, air power, gas power, electric power, or hydraulic power.

The locking posts 60 are pivotally mounted to the grip 80 with fasteners 83. As will be further described, the grip 80 is then releasably attached to the side of the boat 100. As is understood, raising or lowering the locking post 60 results in the elongated members 20 to pivot in either the raised position or the collapsed position. Likewise, the first and second upper rails 50 are pivotally mounted to the front and rear cross-posts 30, 40, such pivotal action allows the upper rails 50 to be positioned in either an upright position where the rails 50 are raised above the members 20, or a collapsed position where the rails 50 substantially rest on the members 20. As shown in FIGS. 1 and 2, the upper rails 50, comprise of end sections 55A and an elongated middle section 55B therebetween forming a generally U-shaped configuration.

As best shown in FIGS. 4 and 5, the grip 80 includes a brace member 81 and a gripping member 82. In application, the brace member 81 contacts an interior surface of an edge 101 of the boat 100, and the gripping member 82 connects to an outer lip 102 of the edge 101.

Cables or similar flexible cordlike material (not shown) known in the art can attach to the first and second upper rails 50 and to the elongated members 20. The cables can be selectively adjusted in order to adjust the location, angle or height of the upper rails 50 in relation to the elongated member 20.

In application, sliding the sleeve 67 upward along the length of each of the posts 60 expose the bendable link 65 (shown in FIG. 5) so that each of the posts 60 can bend freely. Then urging either the upper rails 50 the cross-posts 30, 40, or the elongated members 20 downward will activate the cylinders 70 and cause the posts 60 to collapse to a bent and relaxed position so that the elongated members 20 and upper rails 50 rest on the upper edge of the side of the boat 100 as shown in FIG. 3.

As should be appreciated from the description herein, the boat mounted blind 10 is symmetrically constructed with the pair of elongated members 20 on opposite sides of the boat. As such, only the elements of one of the members 20 found on one side of the boat is primarily discussed. It should be understood as shown in the drawings, that the elongated member 20 on the opposite side of the boat is identical to those described, with the exception that the opposite member's 20 set of elements are mere images of the elongated member 20 described.

A unique aspect of blind 10 lies in the manner in which the framework can be readily moved from the raised position to their lowered position. When members 20 are in their raised positions, the camouflage cover substantially conceals the hunter or hunters within the boat. Once ducks are within shooting range, the hunter can easily and quickly move either or both rails 50 to a lowered position for unobstructed shooting. A single hunter may shoot from either side of the boat, or a plurality of hunters may shoot from both sides simultaneously.

Although the description above contains many specificities, these should not be construed as limiting the scope of the invention but as merely providing illustrations of some of the presently preferred embodiments of this invention.

Thus the scope of the invention should be determined by the appended claims in the formal application and their legal equivalents, rather than by the examples given.

I claim:

1. A collapsible blind that is collapsible and adjustable to fit most conventional boats, said blind comprising:

a pair of elongated members, said members are positioned parallel to each other along both sides of the boat, a front cross-post, and a rear cross-post, a first upper rail pivotally connected to said front and rear cross-posts, a second upper rail pivotally connected to said front and rear cross-posts, wherein the first upper rail is parallel to the elongated members, and the second upper rail is parallel to said elongated members and said first upper rail, wherein said elongated members are attached to a side of the boat with a pair of posts, said posts comprising a bendable link disposed at the approximate midway of the length of the post, said post further includes a sleeve selectively positioned along the length of the post, a pair of cylinders having an end connected to the side of the boat and an opposite end connected to the elongated member, a cable releasably attached to the upper rails and the elongated members.

2. A collapsible blind comprising:

a pair of elongated members disposed in parallel relation, a front and rear cross-post attached to said pair of elongated members, wherein said front and rear cross-posts are in parallel relation to one another and in perpendicular relation to the pair of elongated members, a pair of upper rails pivotally attached to said front and rear cross-posts in parallel relation to said pair of elongated members, wherein each of said elongated members is pivotally attached to a side of a boat with a pair of posts, said posts comprising a lower portion hinged with the boat, an upper portion hinged to the elongated member, a bendable link sandwiched between the upper and lower portions, and a sleeve member, wherein said bendable link is disposed at the approximate midway of the length of the post.

3. The collapsible blind as recited in claim 2, wherein the lower portion of the post includes a stop.

4. The collapsible blind as recited in claim 2, wherein each of said elongated members further include at least one cylinder, said at least one cylinder includes a ram having an end attached to the side of the boat and an opposite end of the cylinder connected with said elongated member.

5. The collapsible blind as recited in claim 4, wherein said ram is telescopically adjusted to an extended or retracted position.

6. The collapsible blind as recited in claim 5, wherein extending the ram adjusts the blind to a raised position, and retracting the ram adjusts the blind to a collapsed position.

7. The collapsible blind as recited in claim 2, wherein said posts further include a grip hingedly attached to said lower portion, wherein said grip is releasably attached to the side of the boat.

8. The collapsible blind as recited in claim 2, further including adjustable cables releasably attached to said upper rails and said elongated members, said cables to position said upper rails in selected relation to said elongated members.

9. The collapsible blind as recited in claim 2, wherein said bendable link is constructed of a #50 roller chain.

10. The collapsible blind as recited in claim 2, wherein said rear cross-post includes an offset.

11. The collapsible blind as recited in claim 2, wherein each of the pair of elongated members comprising a first lower member and a second lower member selectively positioned within a lower sleeve, and wherein each of said pair of upper rails comprising a first upper member and a second upper member selectively positioned within an upper sleeve, such that the length of the blind is adjustable.

12. The collapsible blind as recited in claim 2, wherein said front cross-post comprising a first front member and a second front member selectively joined within a front sleeve, and wherein said rear cross-post comprising a first rear member and a second rear member selectively joined within a rear sleeve, such that the width of the blind is adjustable.

13. A collapsible blind comprising:

a frame, said frame having adjustable means to adjust the length and the width of said frame width, a plurality of locking posts, wherein said frame is pivotally attached to a side of a boat with said plurality of posts, each of said plurality of posts comprising a bendable link disposed at the approximate midway of the length of the post, wherein each of said plurality of locking posts further includes a sleeve and a stop disposed on a lower portion of said post.

14. The collapsible blind as recited in claim 13, wherein said frame having a rear cross-post, said rear cross-post including an integral offset.

15. The collapsible blind as recited in claim 13, further includes at least a first cylinder attached to a first side of the frame, and at least a second cylinder attached to an opposite second side of the frame, wherein said cylinders each including a ram having an end attached to the side of the boat and an opposite end of the cylinder connected with said frame.

16. The collapsible blind as recited in claim 15, wherein the ram is telescopically adjusted to an extended or retracted position.

17. The collapsible blind as recited in claim 16, wherein extending the ram adjusts the blind to a raised position, and retracting the ram adjusts the blind to a collapsed position.

18. The collapsible blind as recited in claim 13, wherein the bendable link is constructed of a #50 roller chain.

19. The collapsible blind as recited in claim 13, wherein the locking posts further include a grip pivotally attached to a lower portion of the post, and wherein said grip is releasably attached to a side of a boat.

* * * * *